US008806775B2

(12) United States Patent
Kim et al.

(10) Patent No.: US 8,806,775 B2
(45) Date of Patent: Aug. 19, 2014

(54) METHOD FOR OPERATING CLOTHES TREATING APPARATUS

(75) Inventors: Minji Kim, Seoul (KR); Hyojin Ko, Seoul (KR); Yongcheol Jin, Seoul (KR); Sanghun Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 424 days.

(21) Appl. No.: 13/178,940

(22) Filed: Jul. 8, 2011

(65) Prior Publication Data

US 2012/0005918 A1 Jan. 12, 2012

(30) Foreign Application Priority Data

Jul. 9, 2010 (KR) ..... 10-2010-0066546
Jul. 9, 2010 (KR) ..... 10-2010-0066550
Jul. 9, 2010 (KR) ..... 10-2010-0066552
Jul. 9, 2010 (KR) ..... 10-2010-0066553

(51) Int. Cl.
*F26B 3/00* (2006.01)
*D06F 58/28* (2006.01)

(52) U.S. Cl.
CPC ..... *D06F 58/28* (2013.01); *F06F 2058/2877* (2013.01); *D06F 2058/289* (2013.01); *D06F 2058/2838* (2013.01)
USPC ..... 34/413; 34/497; 68/5 C; 68/20; 8/159

(58) Field of Classification Search
USPC ..... 34/380, 381, 411, 413, 491, 497; 68/5 C, 5 R, 19, 20; 8/137, 149, 159
See application file for complete search history.

(56) References Cited

U.S. PATENT DOCUMENTS

| | | | | | |
|---|---|---|---|---|---|
| 2,873,537 | A * | 2/1959 | Gray, Jr. et al. | ..... | 34/75 |
| 2,961,776 | A * | 11/1960 | Hughes | ..... | 34/607 |
| 3,363,326 | A * | 1/1968 | Weeks | ..... | 34/528 |
| 3,514,867 | A * | 6/1970 | Patrick | ..... | 34/527 |
| 3,643,341 | A * | 2/1972 | Magin | ..... | 34/444 |
| 3,811,202 | A * | 5/1974 | Arendt | ..... | 34/599 |
| 4,586,267 | A * | 5/1986 | Sussman | ..... | 34/490 |
| 4,689,896 | A * | 9/1987 | Narang | ..... | 34/82 |
| 5,555,645 | A * | 9/1996 | Joslin | ..... | 34/499 |
| 6,282,928 | B1 | 9/2001 | Fukumoto et al. | | |
| 8,276,293 | B2 * | 10/2012 | Ricklefs et al. | ..... | 34/595 |
| 8,375,599 | B2 * | 2/2013 | Dey et al. | ..... | 34/595 |
| 2008/0141558 | A1 * | 6/2008 | Bae et al. | ..... | 34/595 |

(Continued)

FOREIGN PATENT DOCUMENTS

| | | |
|---|---|---|
| CH | 659 841 A5 | 2/1987 |
| DE | 25 37 821 A1 | 3/1977 |

(Continued)

*Primary Examiner* — Steve M Gravini
(74) *Attorney, Agent, or Firm* — Birch, Stewart, Kolasch & Birch, LLP

(57) ABSTRACT

A method for operating a clothes treating apparatus having a dry function capable of reducing abrasion and crease of a dry object and improving a dry efficiency is provided. The method for operating a clothes treating apparatus having a dry function for drying the clothes by supplying hot air into the interior of a tub includes: supplying hot air into the interior of the tub while forwardly and reversely rotating the tub; detecting the moisture content of the clothes put into the interior of the tub; lowering the temperature of hot air and supplying the same when the detected moisture content is less than a first predetermined level; and supplying the hot air having a lower temperature to complete drying.

18 Claims, 12 Drawing Sheets

(56) References Cited

U.S. PATENT DOCUMENTS

| | | | | |
|---|---|---|---|---|
| 2010/0060467 | A1 | 3/2010 | Lee | |
| 2012/0005918 | A1 * | 1/2012 | Kim et al. | 34/491 |
| 2012/0260520 | A1 * | 10/2012 | Hong et al. | 34/604 |

FOREIGN PATENT DOCUMENTS

| | | | |
|---|---|---|---|
| DE | 40 32 079 | A1 | 4/1992 |
| DE | 10 2006 053 379 | A1 | 6/2007 |
| DE | 10 2006 015 143 | A1 | 10/2007 |
| EP | 0 428 846 | A1 | 5/1991 |
| EP | 0 915 199 | A1 | 5/1999 |
| EP | 1 321 562 | A2 | 6/2003 |
| EP | 1 420 104 | A1 | 5/2004 |
| EP | 1 508 637 | A2 | 2/2005 |
| EP | 1790769 | A1 * | 5/2007 |
| EP | 1 975 303 | A1 | 10/2008 |
| EP | 2 014 822 | A1 | 1/2009 |
| JP | 7-289793 | A | 11/1995 |
| JP | 2004-248709 | A | 9/2004 |
| KR | 20-2009-0012698 | U | 12/2009 |
| KR | 10-2010-0027032 | A | 3/2010 |

* cited by examiner

METHOD FOR OPERATING CLOTHES TREATING APPARATUS

FIELD OF THE INVENTION

The present invention relates to a method for operating a clothes treating apparatus having a dry function capable of reducing abrasion and crease of a dry object and improving a dry efficiency.

DESCRIPTION OF THE RELATED ART

In general, in a clothes treating apparatus having a dry function, such as a washing machine or a dryer, the laundry which has been completely washed and spin-dried is put into the interior of a tub (or a drum), and hot air is supplied into the interior of the tub to evaporate moisture of the laundry to thus dry the laundry.

For example, among clothes treating apparatuses, a dryer includes a tub rotatably installed within a main body, into which the laundry is put, a driving motor for driving the tub, a blow fan blowing air into the interior of the tub, and a heating unit for heating air to be introduced into the interior of the tub. The heating unit may use thermal energy generated by using electric resistance or heat of combustion generated by combusting gas.

The dryer uses a method of evaporating moisture by exposing a dry target to heated air. Thus, how to supply heated air to the dry target is an important factor in dry efficiency, and the behavior of the dry target is also a key factor.

In the general clothes treating apparatus, a dry process does not explicitly consider how such a dry target is exposed to heated air, causing a problem in that heated air is not sufficiently used and discharged to result in a waste of power. Also, since the dry target is directly exposed to heated air, clothes are vulnerable to abrasion in contact with the tub or in contact between dry targets.

Meanwhile, in the related art dryer, as described above, in the process of drying the laundry while supplying hot air into the interior of the tub, the moisture content of the laundry is measured by using a humidity sensor mounted in the interior of the dryer, and when the measured moisture content is smaller than a predetermined level, it is determined that drying is completed and the dry process is terminated. However, the dry process starts by putting the laundry, which has been completely spin-dried by a separate washing machine, into the interior of the tub. In this case, if the laundry entangled in the spin-drying process is put into the interior of the tub as it is, the entangled laundry will be dried in the entangled state, making the laundry creased. Also, drying is continued with the creased laundry to end in the crease-settled laundry when the dry process is completed.

SUMMARY OF THE INVENTION

An aspect of the present invention provides a method for operating a clothes treating apparatus capable of effectively moving a dry target, effectively exposing the dry target to heated air to thus improve dry efficiency and reduce power consumption, and reducing thermal damage and abrasion of the dry target.

Another aspect of the present invention provides a method for operating a clothes treating apparatus capable of minimizing crease although the spin dry-completed laundry is put as it is.

Another aspect of the present invention provides a method for operating a clothes treating apparatus capable of minimizing creases of the laundry in a dry-completed state.

According to an aspect of the present invention, there is provided a method for operating a clothes treating apparatus having a dry function for drying the clothes by supplying hot air into the interior of a tub, including: supplying hot air into the interior of the tub while forwardly and reversely rotating the tub; detecting the moisture content of the clothes put into the interior of the tub; lowering the temperature of hot air and supplying the same when the detected moisture content is less than a first predetermined level; and supplying the hot air having a lower temperature to complete drying.

In the aspect of the present invention, in the dry process of the clothes treating apparatus, the temperature of hot air supplied before the dry completion is relatively lowered than that of a previous stage and drying is continued and then completed. In general, in the dry process, hot air having a temperature of about 200° C. to 300° C. is supplied in the dry process. The results of research of the inventors of the present invention showed that since a large amount of moisture is included in the laundry in the initial stage of the dry process, hot air of the foregoing temperature is required, but as the drying process is progressing, the moisture content of the laundry is lowered, and thus, when hot air of the same temperature is supplied, the temperature of the laundry is increased compared with that of the initial stage of the drying. The temperature of the laundry is increased as the drying is continued, causing creases on the laundry to be settled down immediately before the dry completion step.

The present invention was devised based on the results of the research conducted by the inventors of the present invention. Namely, the temperature of hot air supplied before the dry completion is lowered to loosen creases of the laundry generated in the dry process. In this case, a first level as the moisture content for determining a time at which the temperature of hot air is to be lowered may vary according to types of cloth, but it is set to be greater than the moisture content determined to be dry completion.

Also, the tub is repeatedly forwardly and reversely rotated in the dry process. If the tub is continuously rotated in one direction, the laundry will be entangled in a particular direction, causing the laundry to be creased. Meanwhile, when the tub is forwardly and reversely rotated repeatedly, entanglement of the laundry can be minimized and thus creases in the laundry can be reduced.

Here, the method may further include: stopping the forward and reverse rotation of the tub and rotating the tub in one direction when the detected moisture content is less than the predetermined first level. Namely, when the moisture content is less than the first level, since the laundry has been dried to an extent, although the tub is rotated in one direction, entanglement of the laundry does not occur. Thus, in this case, the tub is rotated in one direction to reduce power consumption. Here, in some cases, it may be advantageous to rotate the tub in a particular direction according to the positions at which hot air is discharged to the interior of the tub. Thus, the rotation in one direction may contribute to shortening of the dry time.

Here, the temperature of hot air may be adjusted by stopping the operation of a heater generating hot wind or lowering an output.

Meanwhile, the method may further include: when the moisture content of the clothes is less than a second level higher than the first level, changing the period of forward and reverse rotation of the tub. As described above, as drying is progressing, the moisture content included in the laundry is gradually reduced to lead to a reduction in the frictional force between the laundry and an inner surface of the tub. Thus, when the moisture content is relatively low, even if the tub is rotated in one direction, entanglement of the laundry is reduced. Thus, the forward and reverse rotation of the tub is changed based on the second level to thus reduce a dry time and power consumption according to the moisture content of the laundry.

Here, the period of the forward and reverse rotation of the tub may be set to be longer when the moisture content is less than the second level.

Also, after the drying is terminated, steam or water may be jetted to the interior of the tub to smooth the laundry stiffened due to the drying and thus lessen the creases.

Meanwhile, the first level of the moisture content may be set to be a value ranging from 10% to 20%.

Meanwhile, when the tub is rotated in one of the forward direction and reverse direction, the rotation speed of the tub may be repeatedly changed from a first speed to a second speed. The first speed may be a speed at which the dry target is tightly attached to the tub by centrifugal force so as to be rotated together with the tub when the tub is rotated, and the second speed may be a speed at which the dry target is separated from the tub by self-weight when the tub is rotated.

The dry target may be tightly attached to the inner side surface of the tub and then separated to float in the air periodically, so a flow path allowing heated air to pass through the dry target can be sufficiently secured. Accordingly, heat transmission can be actively made, improving dry efficiency.

Also, abrasion caused by frictional contact between the dry items can be reduced, and thermal damage due to a direct exposure to the heated air can be reduced. Since the temperature can be maintained as the dry target exposed to the heated air to thus include heat are tightly attached to the tub, the amount of supplied heat can be reduced.

Also, the amount of supplied heat of a heater may be changed according to a change in the rotation speed of the tub. Otherwise, according to the change in the rotation speed of the tub, the heater supplying hot air may be controlled to be turned off at the first speed and turned on at the second speed.

When a dry target which requires a small amount of heat is tightly attached to the tub, the amount of supplied heat may be reduced or stopped, thus reducing power consumption.

Meanwhile, the method may further include a preliminary dry step of forwardly and reversely rotating the tub during a certain period of time before supplying hot air to the interior of the tub. Air which has not been heated may be supplied to the interior of the tub in the preliminary dry step.

Before starting the dry process, only a drum may be repeatedly forwardly and reversely rotated without operating the heater, so that the laundry entangled in the spin-dry process can be loosened or released according to the reciprocal movement of the tub. Such a reciprocal movement is not necessarily effective only after the spin-drying has been performed, but can be also effective when a plurality of wet laundry are lumped together and put into the tub.

Meanwhile, the rotational direction of the tub in one direction may be determined according to the position of a hot air discharge hole formed on a rear plate covering a rear surface of the tub. Namely, the tub is rotatably driven such that the lowest point of the tub is rotatably moved toward a hemispherical side where the hot air discharge hole is positioned on the rear plate when the tub is viewed at a front side. A movement of the clothes, the dry targets, is considered, so a time during which the dry targets are exposed to heated air can be lengthened to increase a dry efficiency.

According to an aspect of the present invention, there is provided a method for operating a clothes treating apparatus having a dry function for drying the clothes by supplying hot air into the interior of a tub, including: a temperature increasing step of increasing temperature of a dry target; a maintaining step of maintaining temperature of the dry target at a certain level; and a cooling step of lowering temperature of the dry target, wherein, in the temperature increasing step and the maintaining step, a rotation speed of the tub with respect to one rotation direction is periodically changed from a first speed to a second speed.

The first speed may be a speed at which the dry target is tightly attached to the tub by centrifugal force so as to be rotated together with the tub when the tub is rotated, and the second speed may be a speed at which the dry target is separated from the tub by self-weight when the tub is rotated.

As described above, the dry target may be tightly attached to the inner side surface of the tub and then separated to float in the air periodically, so a flow path allowing heated air to pass through the dry items can be sufficiently secured. Accordingly, heat transfer can be actively made, improving dry efficiency.

Here, in the maintaining step, the heater supplying hot air is cooperatively operated according to a change in the rotation speed of the tub, such that the heater is turned off at the first speed and turned on at the second speed.

The maintaining step may include: detecting the moisture content of the dry target which has been put into the tub; and lowering temperature of hot air to supply hot air of low temperature to complete drying, when the detected moisture content is less than the predetermined first level. The temperature of hot air may be adjusted by stopping the operation of the heater generating hot wind or lowering an output of the heater.

When the moisture content of the dry target reaches a certain level so the necessity of supplying heat is not high, the amount of supplied heat is reduced, thus reducing power consumption. Also, the temperature of hot air supplied before the drying is completed is lowered to loosen creases of the laundry formed in the dry process.

According to embodiments of the present invention having such a configuration as described above, since a flow path allowing for heated air to pass therethrough can be sufficiently secured in dry targets, so heat can be easily transferred, dry efficiency can be improved, and power consumption can be reduced. Also, abrasion caused by frictional contact of the dry targets can be reduced, and since a direct exposure to heated air is reduced, heat damage of the dry targets caused by exposure to heated air can be reduced.

Also, although the spin dry-completed laundry is put into the tub as it is, the laundry can be prevented from being entangled, improving user convenience. Also, the creases which may be generated on the dry-completed laundry can be minimized, thus improving the performance of the clothes treating apparatus having a dry function.

The foregoing and other objects, features, aspects and advantages of the present invention will become more apparent from the following detailed description of the present invention when taken in conjunction with the accompanying drawings.

DETAILED DESCRIPTION OF THE INVENTION

A clothes treating apparatus according to an embodiment of the present invention will now be described with reference to the accompanying drawings.

Figure 1:
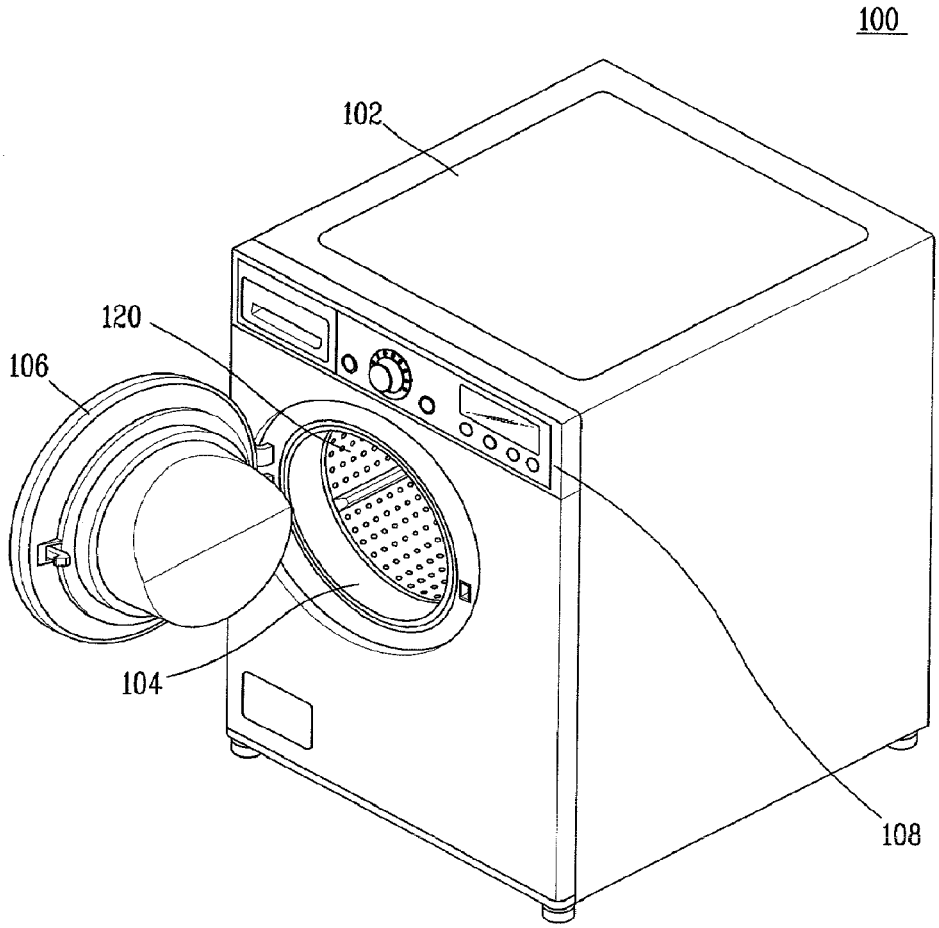
FIG. 1 is a schematic perspective view of a clothes treating apparatus according to an embodiment of the present invention.

FIG. 1 is a schematic perspective view of a clothes treating apparatus according to an embodiment of the present invention. The embodiment is related to a dryer, but the present invention is not necessarily limited to the drier and can be applicable to any type of clothes treating apparatus which supplies hot air to dry the laundry and discharges the hot air used for drying the laundry to the outside.

With reference to FIG. 1, a dryer 100 includes a main body 102 constituting an external appearance of the device and a tub 120 rotatably provided in the interior of the main body 102 and accommodating a dry target therein. An input hole 104 is formed on a front surface of the main body 102, through which the clothes as a dry target is put into the main body 102. The input hole 104 is opened and shut by a door 106, and a control panel 108 is positioned at an upper side of the input hole 104. Various buttons for controlling the dryer 100 are disposed on the control panel 108.

Figure 2:
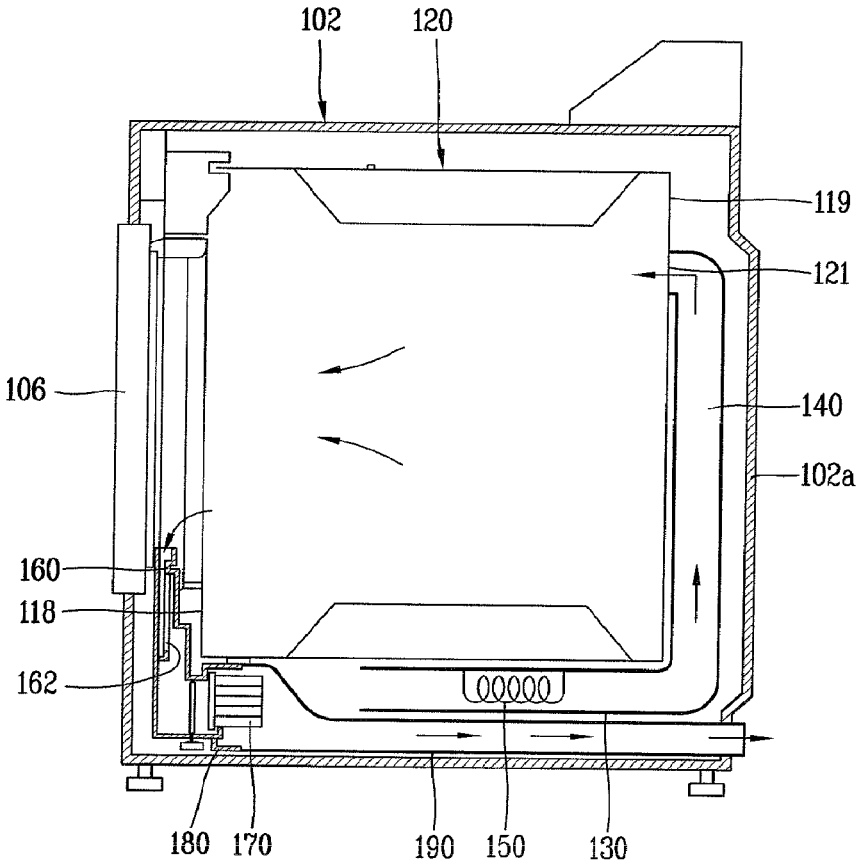
FIG. 2 is a schematic sectional view showing an internal structure of the clothes treating apparatus of FIG. 1.
Figure 3:
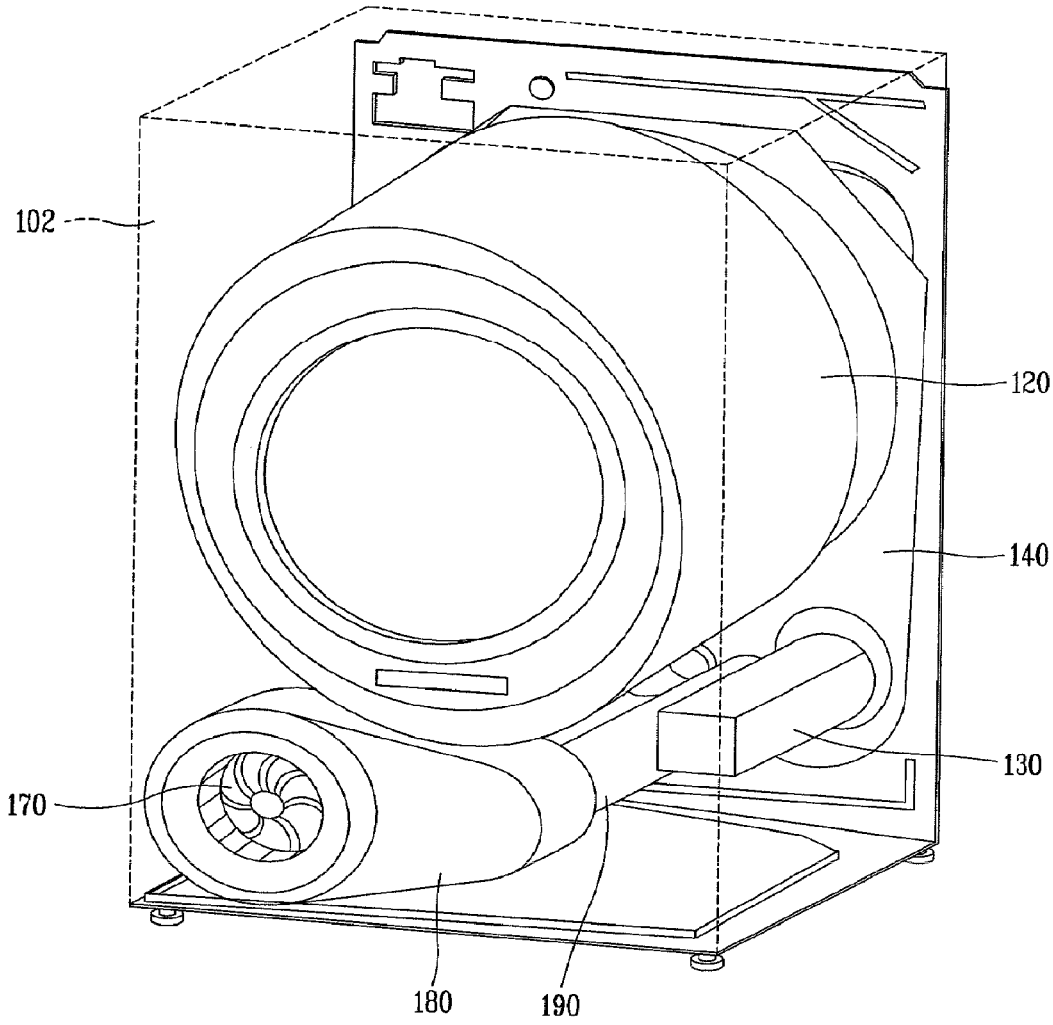
FIG. 3 is a perspective view showing the internal structure of the clothes treating apparatus of FIG. 1.

FIGS. 2 and 3 are a sectional view and a perspective view showing an internal structure of the dryer 100. With reference to FIGS. 2 and 3, a tub 120 is rotatably installed within the main body 102, in which a dry target is dried. The tub 120 is rotatably supported by supporters at a front side and a rear side. The tub 120 is connected to a belt (not shown) and a driving motor (not shown) provided at a lower portion of the dryer 100 and is rotatably driven upon receiving a rotational force therefrom.

Front and rear sides of the tub 120 are open, and the front side of the tub 120 is covered by a front plate 118 and connected to the outside by the door 104 such that a dry target can be put into the tub. The rear side of the tub 120 is covered by a rear plate 119.

A driving motor (not shown) is provided at a lower portion of the main body 102. The driving motor generates a rotational movement of the tub 120 and includes a rotational shaft. A pulley is connected to the rotational shaft, and the belt connects the pulley and an outer side of the tub 120. Accordingly, a rotational movement generated by a driving motor is transferred to the tub 120 through the belt, making the tub 120 rotated.

A first intake duct 130 is installed at a lower side of the tub 120, and a second intake duct 140 is installed at a rear side of the first intake duct 130 such that it is disposed in a vertical direction of the main body 102. The first and second intake ducts 130 and 140 may suck external air, which has been introduced from the outside and exists in the interior of the main body 102, and supply the same to the interior of the tub 120. A heater 150 is installed within the first intake duct 130 in order to heat low-temperature external air to have a high temperature required for drying the laundry. Also, although not shown, a moisture sensor is additionally provided to measure the moisture content of the dry target which has been put into the tub 120. A certain type of moisture sensor may be used. For example, an electrode sensor for measuring moisture based on a change in resistance according to the moisture content through a pair of electrodes may be used.

Here, the first and second intake ducts 130 and 140 are two physically separated elements, but the present invention is not necessarily limited thereto and the first and second intake ducts 130 and 140 may be integrally formed.

Here, external air is sucked through an intake hole (not shown) formed on the main body 102. The introduced external air, which is heated to have a high temperature of about 300° C. by the heater 150, flows into the interior of the tub 120 to dry the laundry and flows to a front duct 160 positioned at a lower portion of a front surface of the tub 120.

Meanwhile, the air introduced to the front duct 160 includes a foreign object such as lint, dust, or the like, existing on the surface of the laundry, s in order to filter out such a foreign object, a lint filter 162 is installed in the front duct 160 so that a foreign object can be filtered out when introduced air flows through the lint filter 162.

A first exhaust duct 180 is connected to the front duct 160. The first exhaust duct 180 forms a portion of an air exhaust flow path for discharging hot air, which has passed through the front duct 160, to the outside of the main body 102. A blowing fan 170 for sucking air within the tub 120 and forcibly blowing it to the outside of the dryer 100 is installed at the inner side in order to allow an air flow to be generated through the foregoing intake flow path and exhaust flow path.

In the embodiment of the present invention, the blowing fan 170 is a pool type blowing fan which exists on a duct exhausting air in the tub 120 and sucks air discharged from the tub toward the exhaust duct. However, according to a configuration of the dryer 100, the blowing fan 170 may be positioned within the first intake duct 130 through which hot air is supplied to the tub 120 so as to push heated air within the intake duct 130 to the tub 120, and this type is called a push type blowing fan.

The blowing fan 170 may be driven by a motor, different from the foregoing driving motor. Thus, the blowing fan 170 and the tub 120 may be independently rotated, and the driving motor for driving the tub 120 may include an inverter control circuit in order to control the rotational direction and speed.

Meanwhile, a second exhaust duct 190 is disposed at a rear stage of the first exhaust duct 180, and an end portion of the second exhaust duct 190 may communicate with the outside of the main body 102 so as to serve as an exhaust hole. As a result, an exhaust flow path is formed by the first air exhaust duct 180, the second air exhaust duct, and the connection portion. Accordingly, air sucked through the first intake duct 130 is discharged to the outside of the main body 102 sequentially through the second intake duct 140, the tub 120, the front duct 160, the first exhaust duct 180, and the second exhaust duct 190. In this case, a duct connected to the outside in the space according to the present embodiment may be provided in the second exhaust duct 190 to directly discharge an exhaust air to an outdoor space, or a heat exchanger may be installed in the second exhaust duct 190 to cool and condense exhaust air and discharge the same to an indoor space.

A driving motor (not shown) is provided at a lower portion of the main body 102. The driving motor includes a rotational shaft for generating a rotational movement of the tub 120. A pulley is connected to the rotational shaft, and a belt connects the pulley and an outer side of the tub 120. Accordingly, the rotational movement generated by the driving motor is transmitted to the tub 120 through the belt, so the tub 120 makes a rotational movement.

Figure 4A:
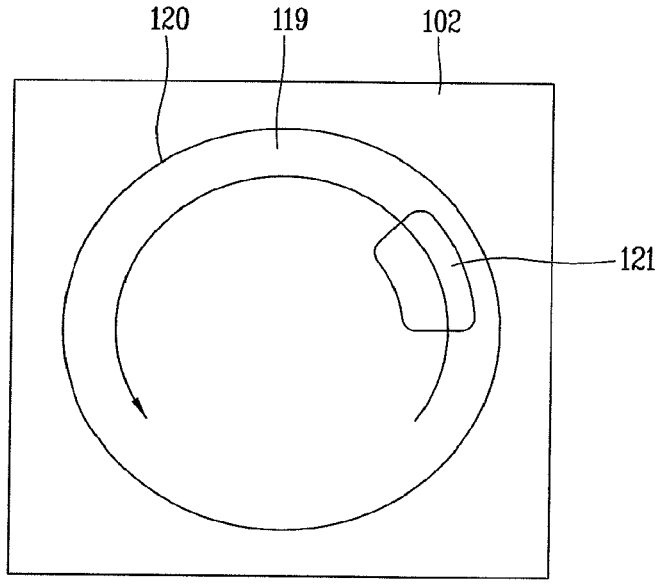
FIGS. 4A and 4B are a schematic view showing a movement of a dry target within the clothes treating apparatus of FIG. 1.
Figure 4B:
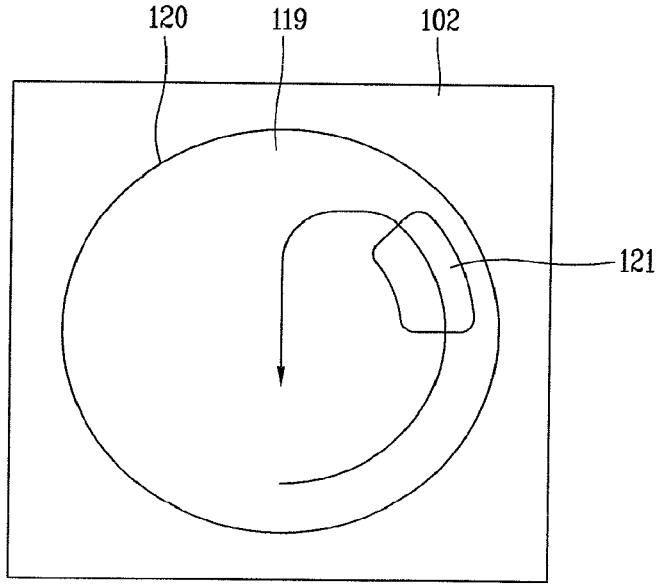

The dry target accommodated in the interior of the tub 120 is rotated according to the rotational movement of the tub 120, and the dry target moves in the interior of the tub 120. FIGS. 4A and 4B show a movement path of the dry target within the tub 120. Here, the tub 120 makes a rotational movement, while the rear plate 119 is fixed. Thus, the dry target is relatively moved as indicated by the arrow in FIGS. 4A and 4B with respect to the fixed rear plate 119.

Here, a hot air discharge hole 121 is formed on the rear plate 119. Air outside the dryer 100 flows into the main body 102 and is transmitted to the heater 150 by the blowing fan 170. As the air passes through the heater 150, it is changed to be hot by the heater, transmitted to the hot air discharge hole 121 through the first and second intake ducts 130 and 140, and then, discharged to the interior of the tub 120.

Figure 5:
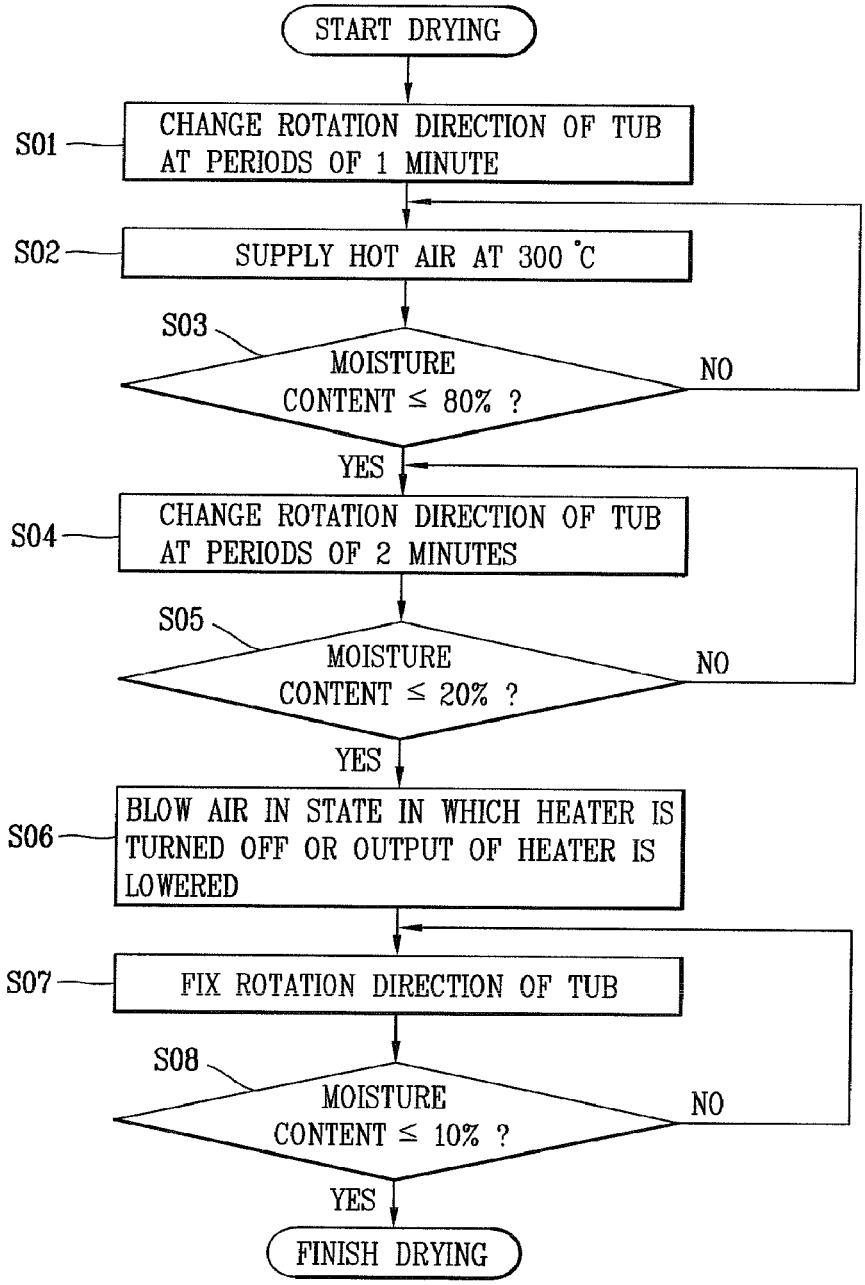
FIG. 5 is a flow chart illustrating a drying process in FIG. 1.

A dry process according to an embodiment of the present invention will now be described. FIG. 5 is a flow chart illustrating a drying process according to an embodiment of the present invention. With reference to FIG. 5, when a user puts the laundry, a dry target, into the interior of the tub 120 and starts the operation through the control panel, the tub 120 is rotated while changing a rotation direction of the tub 120 periodically in units of one minute in step S01. Immediately when step S01 is performed, the heater is operated to supply hot air having a temperature of about 300° C. to the interior of the tub 120 to perform drying in step S02.

In the process, the moisture content included in the laundry is continuously checked by the moisture sensor, and when the moisture content is 80% or smaller (step S03), the rotation period of the tub 120 is changed to 2 minutes. If the moisture content exceeds 80%, the process is returned to step 02 to continuously perform drying. Here, the moisture content of about 80% corresponds to a second level (to be described), and the moisture content of about 20% corresponds to a first level (to be described).

The case in which the moisture content of the clothes is more than the first level but less than the second level corresponds to a step in which the forward and reverse rotation period of the tub 120 is changed. Here, the forward and reverse rotation period of the tub 120 is set to be longer when the content of moisture is less than the second level. As the drying is processing, the content of moisture included in the laundry is gradually reduced, which leads to a reduction in a frictional force between the laundry and the inner surface of the tub 120. Thus, when the content of moisture is relatively low, even if the tub 120 is rotated in one direction, entanglement of the laundry is less generated, so the forward and reverse rotation period of the tub 120 is changed based on the second level, thus reducing a dry time and power consumption according to the moisture content of the laundry.

Figure 6:
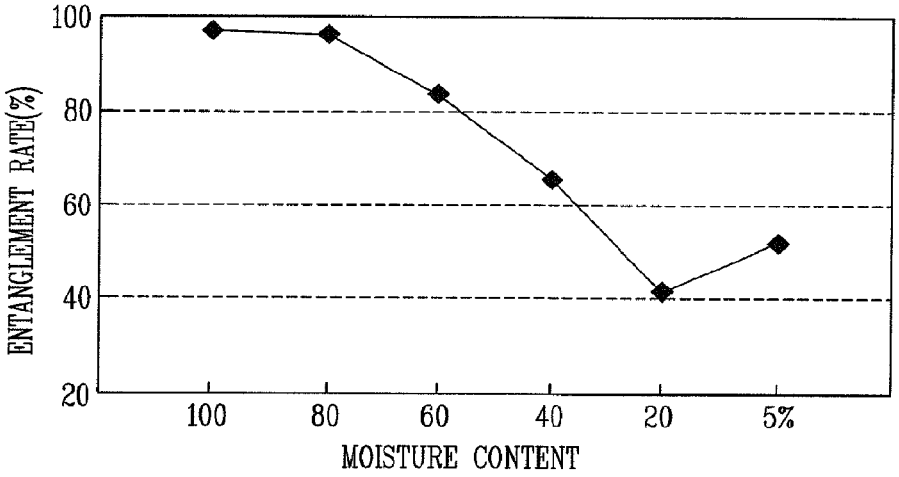
FIG. 6 is a graph showing a change of an entanglement rate according to the moisture content of the laundry

Meanwhile, the reason for determining that the reference point (the second level) for changing the rotation period of the tub 120 as the moisture content of about 80% is illustrated in FIG. 6. FIG. 6 is a graph showing a change of an entanglement rate according to the moisture content of the laundry. When the content of moisture at a point in time when the laundry is put into the tub 120 is 100%, it is noted that the an entanglement rate is maintained at 100% until when the content of moisture becomes 80%, and the entanglement rate is sharply reduced as the content of moisture is less than 80%. Namely, in this state, if the rotation period of the tub 120 is long, entanglement would be generated. Thus, in order to prevent entanglement, the forward and reverse rotation period of the tub 120 is set to be 1 minute in step S03. Of course, the forward and reverse rotation period may be set to be shorter or longer, but in any cases, the forward and reverse rotation period is required to be set to be shorter than the period in step S04.

Figure 7:
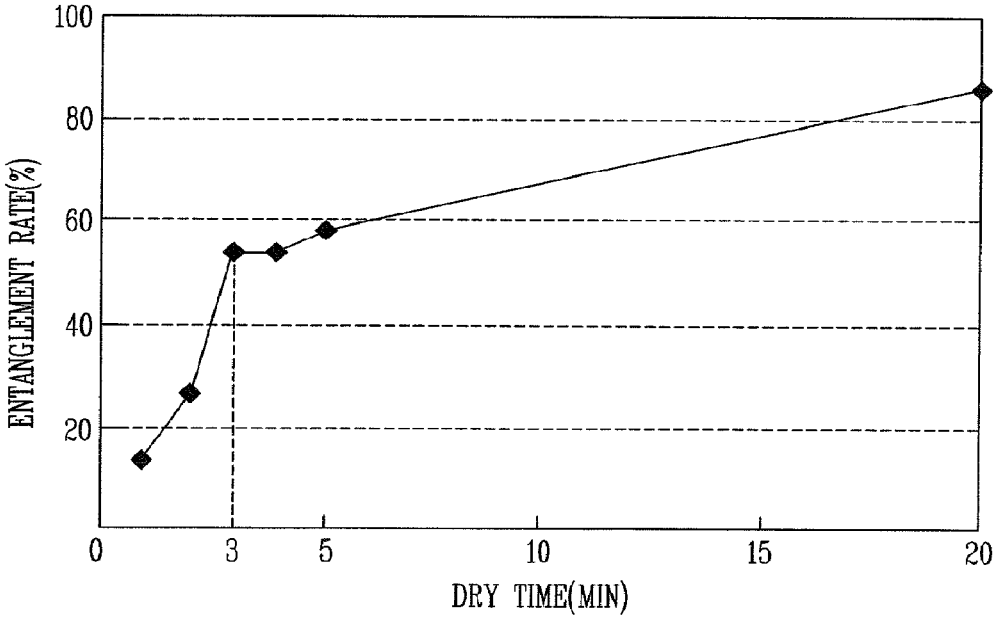
FIG. 7 is a graph showing a change in an entanglement rate of the laundry according to a rotation time with respect to the same moisture content.

Meanwhile, when the moisture content is 80% or less, entanglement is considerably reduced. Thus, in such a case (step S04), the rotation period of the tub 120 is set to be two minutes, which is relatively longer, and the drying is continued. FIG. 7 is a graph showing a change in the entanglement rate of the laundry when one-directional rotation is continued in the state in which the same moisture content is maintained. With reference to FIG. 7, it is noted, as for the entanglement rate, that the entanglement is mostly generated within three minutes after the rotation starts. Thus, in step S04, the forward and reverse period is set to be 2 minutes in order to prevent a generation of entanglement to an extent and minimize an increase in power consumption according to a frequency forward and reverse rotation of the tub 120 and a dry time.

Meanwhile, in the present embodiment, the temperature of hot air supplied before the dry completion is relatively lowered compared with a previous step and drying is continued and completed. Namely, when the detected moisture content is less than the first level (step S05), the temperature of hot air is lowered to perform drying (step S06).

In general, in the dry process, hot air having a temperature of about 200° C. to 300° C. is supplied. The results of research of the inventors of the present invention showed that since a large amount of moisture is included in the laundry in the initial stage of the dry process, hot air of the foregoing temperature is required, but as the drying process is progressing, the moisture content of the laundry is lowered, and thus, when hot air of the same temperature is supplied, the temperature of the laundry is increased compared with that of the initial stage of the drying. The temperature of the laundry is increased as the drying is continued, causing creases on the laundry to be settled down immediately before the dry completion step.

The present invention was devised based on the results of the research conducted by the inventors of the present invention. Namely, the temperature of hot air supplied before the dry completion is lowered to loosen creases of the laundry generated in the dry process.

In this case, a first level as the moisture content for determining a time at which the temperature of hot air is to be lowered may vary according to types of cloth, but it is set to be greater than the moisture content determined to be dry completion. In the present embodiment, the first level of the moisture content set to range from 10% to 20%. Also, the second level, a numerical value compared with the first level, is set to be a value of about 80% as mentioned above. In order to lower the temperature of hot air, the operation of the heater may be stopped or an output of the heater is lowered.

Meanwhile, when the detected moisture content is less than the predetermined first level, the temperature of hot air exhausted from the tub 120 may be maintained to be 40° C. or lower. Here, the temperature of hot air may be adjusted by stopping the operation of the heater or lowering the output of the heater.

Here, when the detected moisture content is less than the predetermined first level (step S05), step (S07) of stopping the forward and reverse rotation of the tub 120 and rotating the tub 120 in one direction may be additionally performed. Namely, when the moisture content is less than the first level, since the laundry has been dried to an extent, although the tub 120 is rotated in one direction, entanglement of the laundry does not occur. Thus, in this case, the tub is rotated in one direction to reduce power consumption. Here, in some cases, it may be advantageous to rotate the tub in a particular direction according to the positions at which hot air is discharged to the interior of the tub.

In particular, it was confirmed that when hot air is discharged from the hot air discharge hole 121 eccentric to the right side, rather than from the center of the tub 120 as shown in FIGS. 4A and 4B, a dry time varies according to the rotation direction of the tub 120. Namely, as shown in FIGS. 4A and 4B, since the hot air discharge hole is positioned at the right portion, the right portion of the tub 120 is maintained to be at a higher temperature than that of the left portion of the tub 120. In this state, when the tub 120 is rotated in a clockwise direction based on the front side of the main body, the laundry which has reached an upper portion of the tub 120 is dropped to a lower surface of the tub 120, lengthening a time during which the laundry is positioned at the left portion, and thus, a dry time is lengthened.

Conversely, when the tub 120 is rotated in a counterclockwise direction as shown in FIG. 4B, since a time during which the laundry stays at the right portion is lengthened, shortening the dry time. Thus, in step S07, the drum is controlled to be continuously rotated in the counterclockwise direction. Accordingly, the dry time can be shortened.

The determination of the rotation direction of the tub 120 is to form a movement path of the dry target in consideration of the position of the hot air discharge hole. The rotation direction of the tub 120 is determined according to the position of the hot air discharge hole on the rear plate.

Figure 13A:
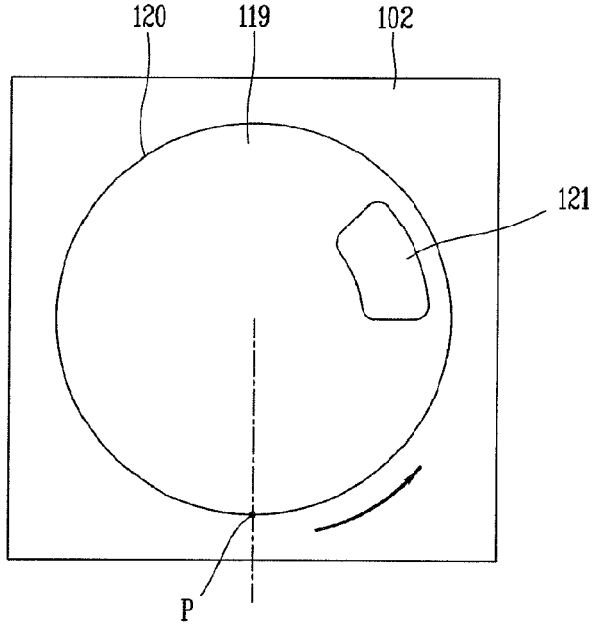
FIGS. 13A and 13B are a schematic view showing a relationship between a position of a hot air discharge hole and a rotation direction of the tub in FIG. 1.
Figure 13B:
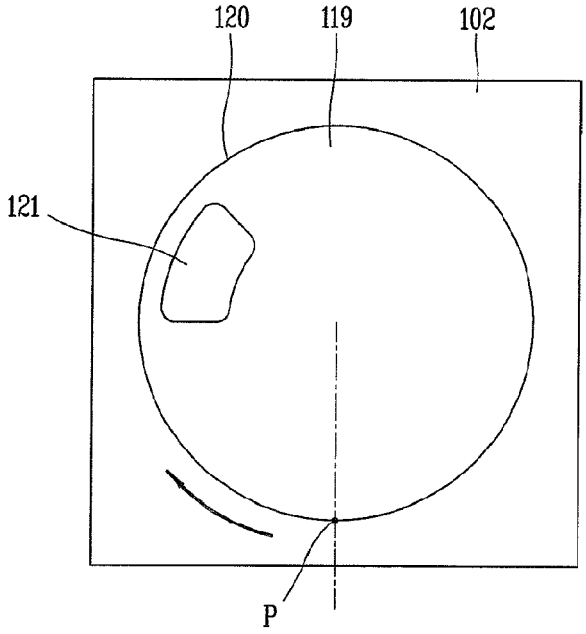

In detail, as shown in FIGS. 13A and 13B, the tub 120 is rotated such that the lowermost point P of the tub 120 is rotatably moved to the hemispherical side where the hot air discharge hole 121 is positioned on the rear plate 119 when the tub 120 is viewed from the front side. The hemisphere where the hot air discharge hole is positioned may be divided into a left hemisphere and a right hemisphere based on an extending line of a straight line connecting the lowermost point P of the tub 120 and a rotation center of the tub 120.

In FIG. 13A, when the rear plate is viewed at a front side, the hot air discharge hole is positioned at the right hemisphere of the rear plate. Thus, in this case, the tub 120 is rotated in the counterclockwise direction. Also, in FIG. 13B, when the rear plate is viewed at the front side, the hot wind discharge hole is positioned at the left hemisphere of the rear plate. Thus, in this case, the tub 120 is rotated in the clockwise direction.

According to the method for driving the clothes dryer having the foregoing configuration according to an embodiment of the present invention, a movement of the dry target is considered, a time duration in which the dry target is exposed to heated air is increased, thus increasing the dry efficiency.

In detail, the dry target is rotated within the tub 120, but it is not rotated completely but lowered by self-weight. Thus, as shown in FIG. 4B, the clothes rotatably goes up from the lowermost point of the tub and then dropped at a certain height, having a movement path similar to a semi-circle. Thus, the position of the hemisphere formed by the path of the dry target varies according to the rotation direction of the tub 120.

Moisture of the dry target is evaporated through heat exchange with heated air, and as a time during which the dry target is exposed to the heated air is increased, the amount of evaporated moisture is increased. Thus, when a movement path of the dry target is formed at the hemisphere side existing where the hot air discharge hole is present, a time during which the dry item is in contact with the heated hot air and the possibility are increased to remarkably improve the dry efficiency.

In the present embodiment, when the dry process is divided based on the first level and the second level as follows: a section from a point in time at which drying starts to a point in time at which the moisture content reaches the second level is first section, a section from the point in which at which the moisture content is the second level to a point in time at which the moisture content reaches the first level, and a section from the point in which at which the moisture content is the first level to a point in time at which drying is completed. In this case, the forward and reverse rotation period of the drum at the first section is set to be within one minute, and the forward and reverse rotation period of the tub at the second section is set be within three minutes. The forward and reverse rotation period of the tub at the second section may be set t be longer than that at the first section. At the third section, the drum is rotated in one direction. Thereafter, when it is checked that the content of moisture is 10% or less (step S08), the dry process is terminated.

Figure 8:
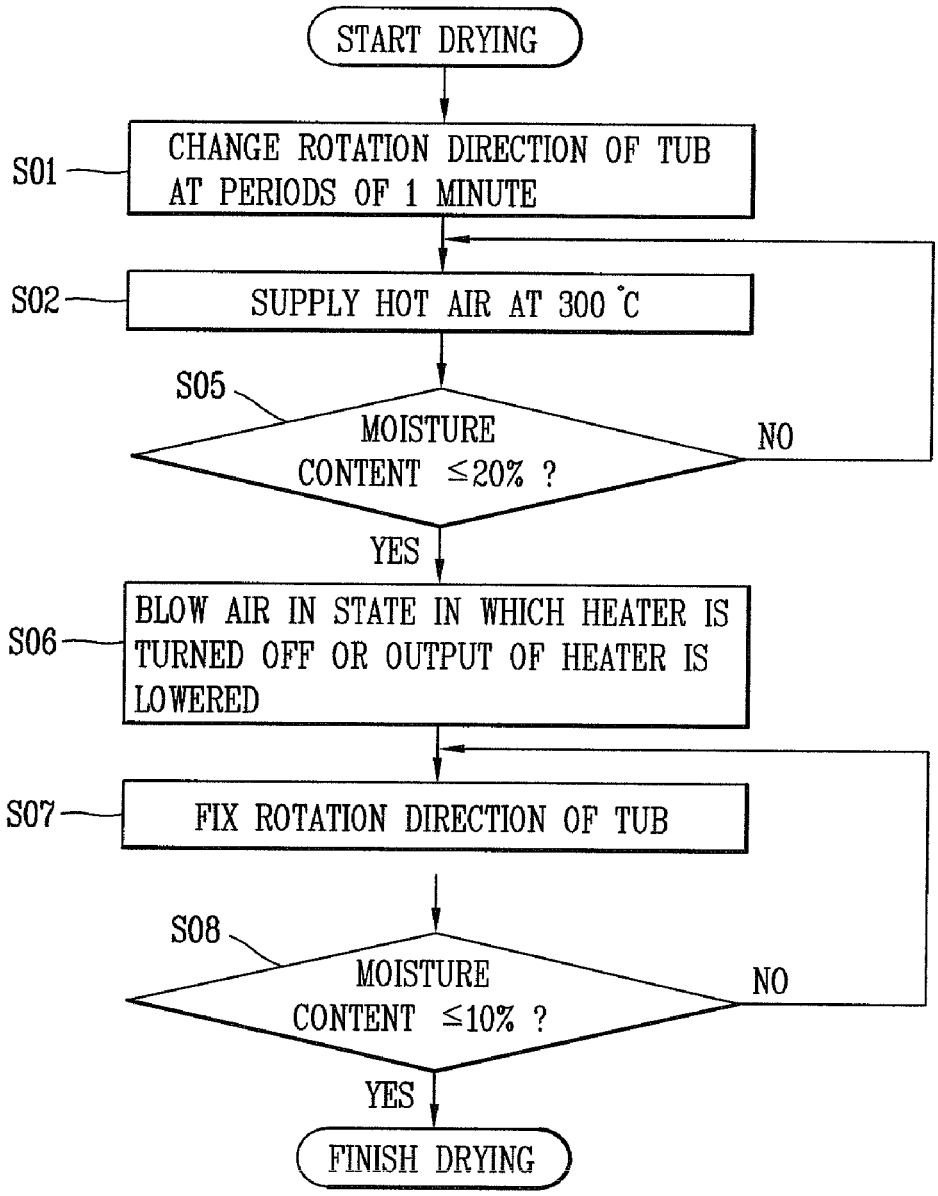
FIG. 8 is a flow chart illustrating another drying process in FIG. 1.

FIG. 8 is a flow chart illustrating another drying process in FIG. 1. The same reference numerals will be used for the same elements as those of the embodiment illustrated in FIG. 5, and a repeated description will be omitted.

The process illustrated in FIG. 8 is basically same as that illustrated in FIG. 5, except that steps S03 and S04 are excluded in FIG. 5. Thus, in the dry process illustrated in FIG. 8, when the moisture content exceeds 20%, the tub repeatedly makes a forward and reverse rotation continuously in units of one minute, and only when the moisture content is 20% or less, the tub is continuously rotated in the counterclockwise direction, performing drying.

Meanwhile, in the process illustrated in FIGS. 5 and 8, after step S08, a process of jetting water or steam to the interior of the tub 120 may be additionally performed. In a state in which the drying is completed, when water or stream is jetted to the laundry, the laundry can be softened, the settled creases of the laundry would be loosened, and thus, the creases can be reduced and the dry-completed laundry can be softened.

Figure 9:
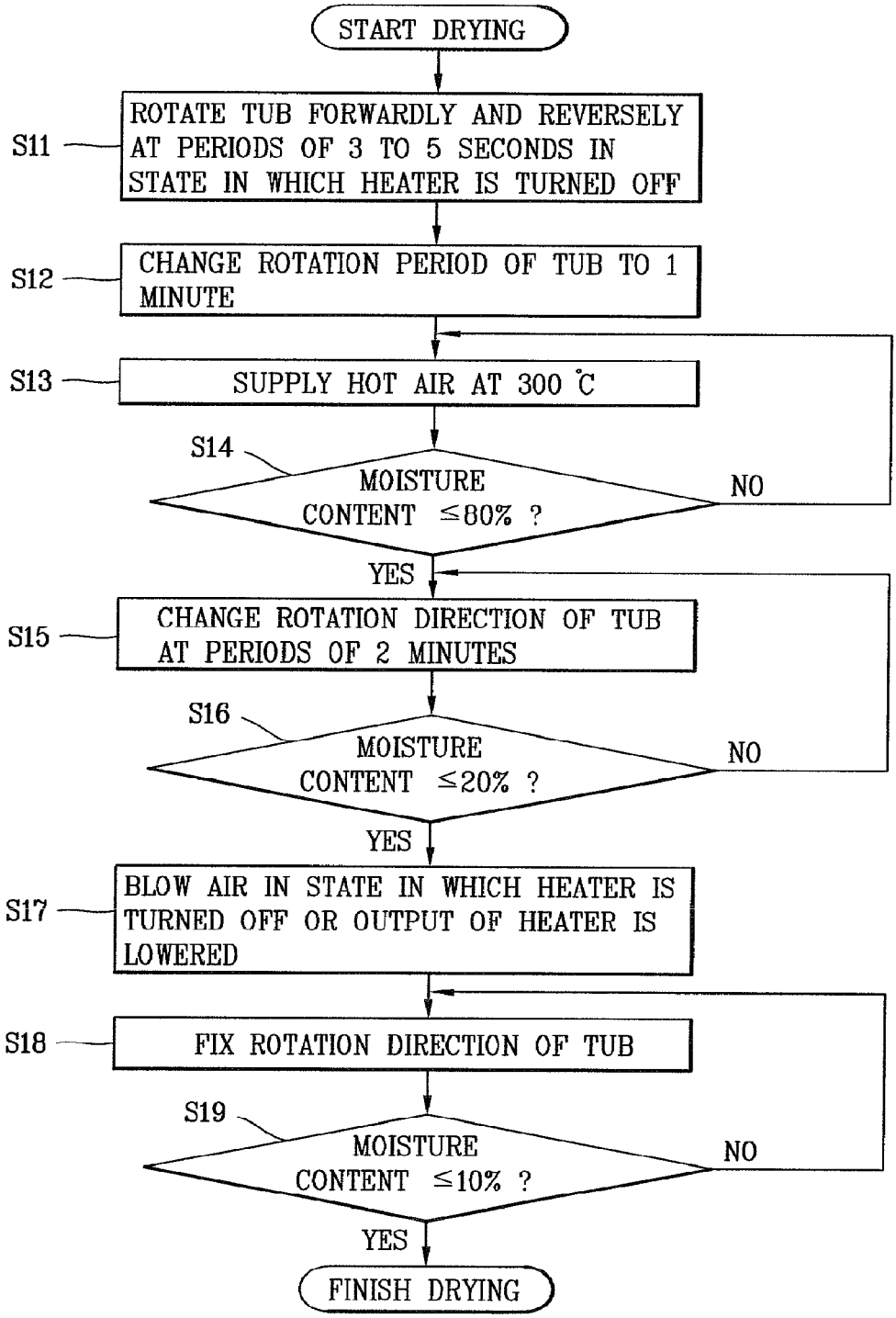
FIG. 9 is a flow chart illustrating a preliminary drying process in FIG. 1.

Meanwhile, a preliminary dry step may be additionally performed before step S01. FIG. 9 is a flow chart illustrating a preliminary drying process in FIG. 1. With reference to FIG. 9, in a preliminary dry step S11, the tub 120 is rotated while changing the rotation direction of the tub at periods (or intervals) of 3 to 5 seconds in a state in which the heater is turned off. Thus, the tub makes a forward and reverse rotation repeatedly at the very short periods, and thus, the entangled laundry can be loosened. In this case, the tub may irregularly repeat the forward and reverse rotation, or may repeat the forward and reverse rotation at certain periods.

After the tub 120 makes the forward and reverse rotation repeatedly for 10 to 20 times in the preliminary dry step S11, the rotation period of the tub 120 is changed to one minute and the tub 120 continuously makes the forward and reverse rotation in step S12. Steps S12 to S19 correspond to steps S01 to S08 in the former embodiment. Thus a repeated description will be omitted.

In this case, the blowing fan is also operated together in the preliminary dry step S11 to allow external air to be introduced into the interior of the tub 120. In this case, the heater is not operated, so air which is not heated and at room temperature is supplied to the interior of the tub 120.

Preliminary dry step is performed before a regular dry process starts. In the preliminary dry step, only the tub makes the forward and reverse rotation repeatedly in a state in which the heater is not operated, so that the laundry which has been entangled in the spin-dry process according to the reciprocal movement of the tub can be loosened. Such a reciprocal movement is not necessarily effective only after the spin-drying has been performed, but can be also effective when a plurality of wet laundry items are lumped together and put into the drum.

Meanwhile, in the above embodiment, the dry process is described by supplying hot air to the dry target, but in a different embodiment of the present invention, the rotation of the tub can be described in a point of view of the temperature of the dry target.

Figure 10:
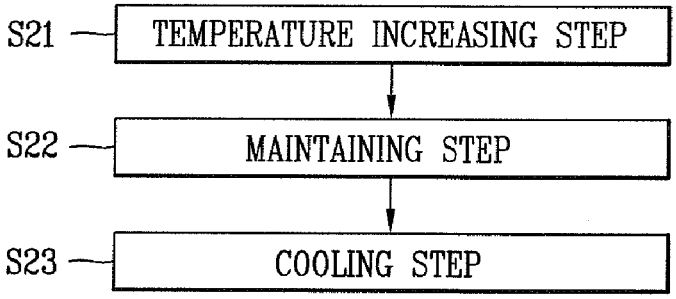
FIG. 10 is a flow chart illustrating a dry process based on temperature of a dry target in FIG. 1.

As shown in FIG. 10, a method for operating a clothes treating apparatus according to another embodiment of the present invention may include a temperature increasing step S21 of increasing temperature of a dry target; a maintaining step S22 of maintaining temperature of the dry target at a certain level; and a cooling step S23 of lowering temperature of the dry target. Here, in the temperature increasing step and the maintaining step, a rotation speed of the tub with respect to any one of the forward direction and the reverse direction of the tub 120 is repeatedly changed from a first speed to a second speed.

In the temperature increasing step S21, namely, in the early dry stage, when a dry target is put into the interior of the dryer, and the dryer is operated, the temperature of the dry target is increased by the heat supplied from the heater. In the maintaining step S22, the temperature of the dry target which has been increased in the temperature increasing step is almost maintained at a certain temperature, and in the cooling step S23, the dry target is cooled after the dry process is terminated.

The tub 120 is continuously rotated in the forward direction or in the reverse direction in the temperature increasing step S21 and the maintaining step S22, and air heated by the heater is supplied to the interior of the tub 120. This is the same as described above.

Figure 11:
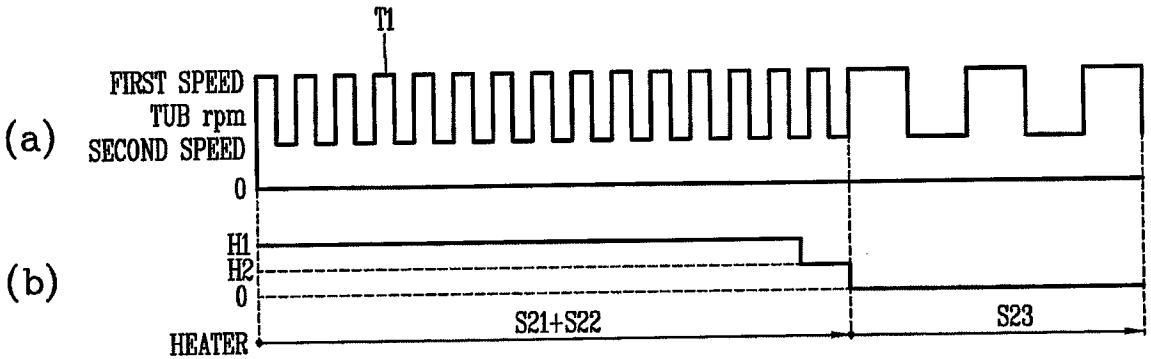
FIGS. 11 and 12 are graphs showing a relationship between a rotation speed of a tub and the amount of supplied heat.

Here, as shown in FIG. 11(*a*), in the temperature increasing step and the maintaining step S21 and S22, the rotation speed of the tub 120 with respect to one rotational direction (one of the forward direction and reverse direction) is changed periodically from the first speed to the second speed.

An effect of changing the rotation speed with respect to any one of the rotation directions of the tub is illustrated in FIGS. 4A and 4B. As shown in FIG. 4A, the first speed is a speed at which the dry target is tightly attached to the tub 120 by a centrifugal force so as to be rotated together with tub when the tub is rotated, and as shown in FIG. 4B, the second speed is a step at which the dry target is separated by self-weight in the tub when the tub is rotated as shown in FIG. 4B.

For example, when the clothes of 3 kg to 5 kg is put into the dryer and rotated, the speed at which the clothes is tightly attached to the inner surface of the tub 120 and rotated is 65 rpm and the speed at which the clothes is separated by self-weight is 50 rpm, in the present embodiment, the first speed is 65 rpm and the second speed is 50 rpm. Also, the period T1 is determined to be 5 seconds.

According to such a configuration, the dry item may be tightly attached to the tub as shown in FIG. 4A, and it may be in a state of being separated from the tub and floated in the air.

The dry efficiency may vary according to the amount of hot air flow as well as the temperature. Thus, the amount of air flow is large and the dry item is greatly in contact with hot air, the dry efficiency can be increased. Namely, when space is formed between dry items and air smoothly passes through therebetween, heat would be smoothly transferred and it would be advantageous for the dry performance. Thus, the state in which the dry target is separated from the tub and is floated in the air is advantageous for the drying. When the dry items are floated in the tub, the dry targets may be abraded and damaged.

Also, when the dry target is tightly attached to the tub, the dry item including the heated air is tightly attached to the tub, having an effect that its temperature is maintained. In this case, the increase in moisture is accelerated and the amount of heat to be supplied is reduced, so it would be advantageous, for drying, for the dry target to be tightly attached to the tub. Meanwhile, when the dry target is tightly attached to the tub, because there is no space allowing air to flow, causing a problem in which heat transfer to the dry item is not effectively performed.

Thus, in the present embodiment, when the dry target is periodically tightly attached to the tub or separated from the tub and floated in the air, the effects that the path of the dry target is deviated to reduce the possibility of thermal damage, and the space allowing air to pass through is smoothly formed between the dry target to properly perform a heat transfer and improve the dry efficiency. Also, the dry item is periodically tightly attached to the tub to reduce abrasion between the dry targets, and the dry target is tightly attached to the tub to maintain the temperature to thus increase an evaporation of moisture and reduce the amount of heat to be supplied are compositely and appropriately harmonized. Namely, the foregoing configuration exhibits an optimum dry performance in consideration of the composite effects, rather than considering only one simple effect, and accordingly, power consumption can be eventually reduced.

Figure 12:
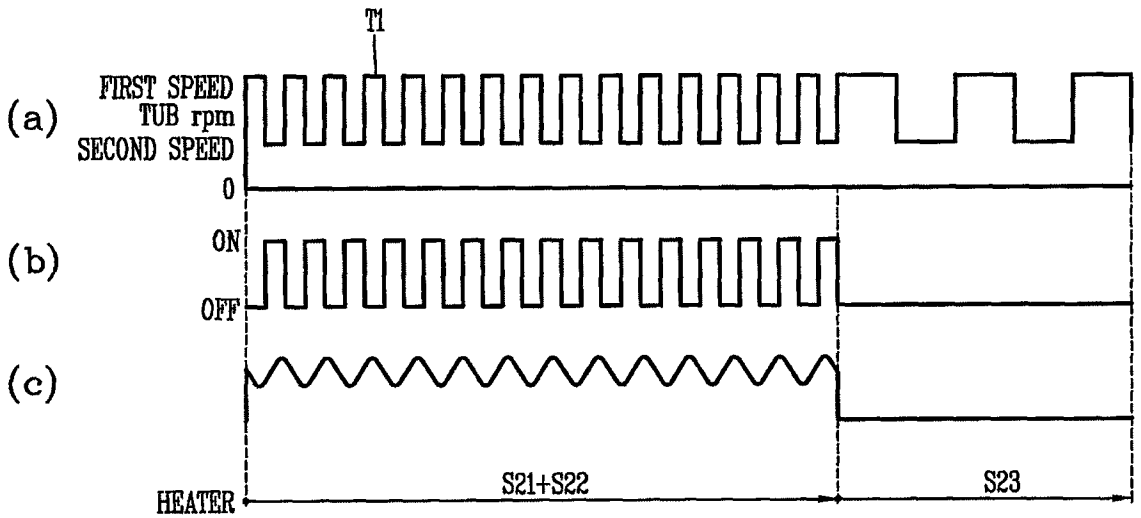

Meanwhile, in the maintaining step S22, the amount of supplied heat by the heater can be changed according to a change in the rotation speed of the tub. FIG. 12 shows such a change in the supplied heat.

In FIG. 12, (a) graph illustrates that the speed of the tub is periodically changed from the first speed to the second speed, and (b) and (c) graphs show that the amount of supplied heat is changed according to a periodical change in the speed of the tub.

As illustrated in the (b) graph of FIG. 12, when the amount of supplied heat is changed, the heater is turned on or off according to a change in the rotation speed of the tub in the maintaining step S22. In such a case, the heater is configured such that it is turned off at the first speed and turned on at the second speed. Accordingly, the heater stops supplying of heat when the rotation speed of the tub is the first speed, and the heater supplies heat when the rotation speed of the tub is the second speed.

The reason for changing the amount of supplied heat in the maintaining step S22 is because, in the temperature increasing step S21, the temperature of the dry target is required to be increased by continuously supplying heat, while, in the maintaining step S22, the temperature of the dry target is not required to be increased, and the dry efficiency can be enhanced and power consumption can be reduced.

Also, when the heater is turned on or off according to the rotation speed of the tub, heat supply is stopped at the first speed at which the dry target is tightly attached to the inner surface of the tub in which heat supply is not much required, thus reducing power consumption. Namely, when the dry target is tightly attached to the tub, the dry target which is exposed to the heated air to include heat is tightly attached to the tub and its temperature is maintained, the necessity of supplying heat is reduced.

Preferably, as shown in (c) graph in FIG. 12, heat supply is controlled by the heater, so that an increase or decrease of the supplied heat can be controlled according to the rotation speed of the tub. Namely, when the rotation speed of the tub is the first speed, the amount of supplied heat is reduced, and when the rotation speed of the tub is the second speed, the amount of supplied heat is increased. Namely, when the heater is turned on, a great amount of energy may be lost, so the amount of supplied heat is controlled, without turning on or off the heater, so as to be periodically changed.

According to the foregoing configuration, the dry target within the tub is tightly attached to the inner surface of the tub and then separated from the tub and floated in the air. Thus, heat supply can be reduced when a dry target, to which a large amount of heat is not required to be supplied, is tightly attached to the tub and rotated, reducing power consumption.

Meanwhile, in the present embodiment, the supplied heat of the heater may be changed according to the moisture content of the dry target. Namely, as show in (b) graph in FIG. 11, when the moisture content of a dry target reaches a certain level, the dry target is dried at a low temperature (H2). This corresponds to the step S06 or S17, and in this case, the heater may be stopped or the output of the heater may be lowered.

For example, in a state in which a certain amount of heat, i.e., 5400 W, is supplied in the temperature increasing step and the maintaining step (S21 and S22), when the moisture content reaches the first level (20%), the amount of supplied heat is reduced to 2700 W. When the moisture content is 20% or less, the amount of moistures is small, and the characteristics of fiber may be easily changed by the influence of temperature, rather than by the influence of frictional coefficient, so the amount of supplied heat is reduced as small as possible. According to such a configuration, when the dry target reaches a certain moisture content so the necessity of supplying heat is lowered, the amount of supplied heat is reduced, to thus reduce power consumption.

Meanwhile, the present invention includes a clothes treating apparatus employing the method for operating a clothes treating apparatus as described above.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A method for operating a clothes treating apparatus having a dry function for drying the clothes by supplying hot air into the interior of a tub, the method comprising:

supplying hot air into the interior of the tub while alternately rotating the tub forwardly and reversely;

detecting the moisture content of the clothes put into the interior of the tub;

lowering the temperature of hot air and supplying the same when the detected moisture content is less than a first predetermined level;

stopping the forward and reverse rotation of the tub and rotating the tub in one direction when the detected moisture content is less than the first predetermined level; and supplying the hot air having a lower temperature to complete drying, wherein the rotational direction of the tub in one direction is determined according to the position of a hot air discharge hole formed on a rear plate covering a rear surface of the tub.

2. The method of claim 1, wherein the temperature of hot air is adjusted by stopping the operation of a heater or lowering an output of the heater.

3. The method of claim 1, further comprising:

when the moisture content of the clothes is less than a second predetermined level higher than the first predetermined level, changing the period of forward and reverse rotation of the tub.

4. The method of claim 3, wherein the period of the forward and reverse rotation of the tub is set to be longer when the moisture content is less than the second predetermined level.

5. The method of claim 3, further comprising:

jetting steam or water to the interior of the tub after the drying is terminated.

6. The method of claim 1, wherein the first predetermined level of the moisture content is set to be a value ranging from 10% to 20%.

7. The method of claim 1, wherein when the tub is rotated in one of the forward direction and reverse direction, the rotation speed of the tub is repeatedly changed from a first speed to a second speed.

8. The method of claim 7, wherein the first speed is a speed at which the dry target is tightly attached to the tub by centrifugal force so as to be rotated together with the tub when the tub is rotated, and the second speed is a speed at which the dry target is separated from the tub by self-weight when the tub is rotated.

9. The method of claim 8, wherein the amount of supplied heat of a heater is changed according to a change in the rotation speed of the tub.

10. The method of claim 9, wherein the heater is cooperatively operated according to the change in the rotation speed of the tub, such that the heater is turned off at the first speed and turned on at the second speed.

11. The method of claim 1, further comprising:

a preliminary dry step of forwardly and reversely rotating the tub during a certain period of time before supplying the hot air to the interior of the tub.

12. A method for operating a clothes treating apparatus having a dry function for drying the clothes by supplying hot air into the interior of a tub, the method comprising:

a preliminary dry step of forwardly and reversely rotating the tub during a certain period of time before supplying the hot air to the interior of the tub;

supplying the hot air into the interior of the tub while alternately rotating the tub forwardly and reversely;

detecting the moisture content of the clothes put into the interior of the tub;

lowering the temperature of hot air and supplying the same when the detected moisture content is less than a first predetermined level; and supplying the hot air having a lower temperature to complete drying, wherein air which has not been heated is supplied to the interior of the tub in the preliminary dry step.

13. The method of claim 1, wherein the tub is rotatably driven such that the lowest point of the tub is rotatably moved toward a hemispherical side where the hot air discharge hole is positioned on the rear plate when the tub is viewed at a front side.

14. A method for operating a clothes treating apparatus having a dry function for drying the clothes by supplying hot air into the interior of a tub, the method comprising:

a temperature increasing step of increasing a temperature of a dry target;

a maintaining step of maintaining the temperature of the dry target at a certain level; and a cooling step of lowering the temperature of the dry target, wherein, in the temperature increasing step and the maintaining step, a rotation speed of the tub in one rotation direction is periodically and alternately changed between a first speed and a second speed per a predetermined period, and during the predetermined period the first speed and the second speed are respectively maintained.

15. The method of claim 14, wherein the first speed is a speed at which the dry target is tightly attached to the tub by centrifugal force so as to be rotated together with the tub when the tub is rotated, and the second speed is a speed at which the dry target is separated from the tub by self-weight when the tub is rotated.

16. The method of claim 15, wherein, in the maintaining step, a heater is cooperatively operated according to a change in the rotation speed of the tub, such that the heater is turned off at the first speed and turned on at the second speed.

17. The method of claim 14, wherein the maintaining step comprises:

detecting a moisture content of the dry target which has been put into the tub; and lowering the temperature of the hot air to supply hot air of a low temperature to complete drying, when the detected moisture content is less than a predetermined level.

18. The method of claim 17, wherein the temperature of hot air is adjusted by stopping the operation of a heater or lowering an output of the heater.

* * * * *